US006243999B1

(12) United States Patent
Silverman

(10) Patent No.: US 6,243,999 B1
(45) Date of Patent: Jun. 12, 2001

(54) BLOW-OUT PREVENTION MECHANISM FOR WINDOWS

(75) Inventor: Arthur Silverman, Warren, NJ (US)

(73) Assignee: Silver Line Building Products Corporation, North Brunswick, NJ (US)

( * ) Notice: Subject to any disclaimer, the term of this patent is extended or adjusted under 35 U.S.C. 154(b) by 0 days.

(21) Appl. No.: 09/304,976

(22) Filed: May 4, 1999

(51) Int. Cl.[7] ..... E06B 3/32

(52) U.S. Cl. ..... 52/204.51; 52/204.62; 52/204.7; 52/207; 52/213; 52/656.5; 52/656.6; 52/656.7; 52/775; 49/449; 49/501

(58) Field of Search ..... 52/202, 203, 204.5, 52/204.51, 204.69, 204.62, 204.7, 207, 213, 475.1, 656.2, 656.5, 656.6, 656.7, 769, 773, 774, 775; 49/76, 181, 419, 501, 449

(56) References Cited

U.S. PATENT DOCUMENTS

| | | | |
|---|---|---|---|
| D. 397,804 | | 9/1998 | Hersh et al. . |
| D. 398,708 | | 9/1998 | Opielski et al. . |
| D. 399,979 | | 10/1998 | Franson . |
| D. 401,359 | | 11/1998 | Porter et al. . |
| D. 402,061 | | 12/1998 | Leonelli . |
| 4,028,849 | | 6/1977 | Anderson . |
| 4,086,727 | | 5/1978 | Kuyper et al. . |
| 4,186,522 | | 2/1980 | Hooks . |
| 4,265,052 | | 5/1981 | Johnson et al. . |
| 4,368,594 | | 1/1983 | Milam et al. . |
| 4,763,445 | | 8/1988 | Silverman . |
| 4,831,804 | | 5/1989 | Sayer . |
| 5,099,624 | * | 3/1992 | Valentin ..... 52/207 |
| 5,430,982 | | 7/1995 | Bane . |
| 5,551,189 | | 9/1996 | Westfall . |
| 5,560,149 | | 10/1996 | Lafevre . |
| 5,934,031 | * | 8/1999 | DeNormand ..... 52/204.5 |

* cited by examiner

*Primary Examiner*—Carl D. Friedman
*Assistant Examiner*—Yvonne M. Horton
(74) *Attorney, Agent, or Firm*—Lerner, David, Littenberg, Krumholz & Mentlik, LLP

(57) ABSTRACT

A storm-resistant window includes a mechanism for preventing the blowout of a movable sash when wind pressure pulls the sash outwardly. In a single hung window having a slidable lower sash, the mechanism consists of a first rib projecting downwardly from the bottom rail of the lower sash and a second rib projecting upwardly from the top of the sill member of the window frame. In a closed position of the window, the first rib lies inwardly adjacent the second rib such that, if wind pressure pulls the movable sash outwardly, the first rib will contact the second rib, preventing the bottom rail of the movable sash from moving outwardly. In an alternate embodiment, one of the ribs may be replaced with a channel, so that the remaining rib is received in the channel in the closed position of the window.

25 Claims, 4 Drawing Sheets

BLOW-OUT PREVENTION MECHANISM FOR WINDOWS

FIELD OF THE INVENTION

The present invention relates to windows, and more particularly to windows having a feature preventing them from blowing outward during extreme storms.

BACKGROUND OF THE INVENTION

Exterior windows mounted in the walls of a commercial or residential building are typically provided to maintain a weather tight barrier against wind and rain. Windows also allow for a view of the exterior and the transmission of light, and preferably have the capability of being opened for ventilation during favorable conditions. If the window does not form an effective weather barrier, there may be damage to the building and/or harm to the occupants during foul weather. In extreme storm conditions, there is the potential for significant damage to the building from poorly sealed windows. Such damage may occur during hurricanes, tornadoes, or particularly severe thunderstorms. For example, in south Florida and along the Gulf Coast, hurricanes occur regularly.

In a strong storm, an exterior window may be subject to winds in excess of 100 mph (160 kph). Wind loading can be sustained, e.g., continuing for significant periods of time, or can occur in gusts and ripples. To withstand such loading, structures require both static and dynamic strength and resilience.

Conventional windows for commercial and residential buildings generally have not been designed to withstand and/or resist the extremes of weather conditions. When subjected to high winds and debris, windows have failed or blown out, allowing weather and debris to invade the building, potentially resulting in structural damage due to the breach of structural integrity.

There therefore exists a need for an improved window construction that better resists the potential for window failure in the event of extreme weather, but that does not interfere with the normal operation of the window. Preferably such improved window construction will be readily manufactured without an undue increase in the cost of manufacture.

SUMMARY OF THE INVENTION

The present invention addresses these needs.

One embodiment of the present invention provides a window assembly including a window frame having a pair of frame side portions connected to a pair of frame end portions, and at least one sash having a sash frame including a pair of end rails and a pair of side rails interconnecting the end rails. The sash is movable in a plane within the window frame between a closed position in which one of its end rails is adjacent one of the frame end portions, and an open position in which the one end rail is spaced from the one frame end portion. A first member having an inner surface facing in a first direction transverse to the plane projects from the one frame end portion toward the one end rail. A second member having an outer surface facing in a direction opposite the first direction projects from the one end rail toward the one frame end portion. In the closed position of the sash, the first and second members are positioned adjacent one another with the inner surface of the first member confronting the outer surface of the second member so as to prevent movement of the sash in the second direction.

The first member may consist of a rib projecting from the frame end portion continuously from one frame side portion to the other frame side portion. Alternatively, the first member may consist of a plurality of structures projecting at spaced intervals from the frame end portion. Similarly, the second member may consist of a rib projecting from the end rail continuously from one side rail to the other side rail, or of a plurality of structures projecting at spaced intervals from the end rail. Where both the first member and the second member include structures arranged at spaced intervals, the respective spaced intervals preferably correspond to one another.

In another embodiment of the present invention, a projecting member may project from the one frame end portion toward the one end rail, and a recess may be formed in the one end rail and be sized and shaped for receiving the projecting member in the closed position of the sash. Alternatively, the projecting member may project from the one end rail toward the one frame end portion, and the recess may be formed in the one frame end portion and be sized and shaped for receiving the projecting member in the closed position of the sash.

The projecting member may consist of a continuous rib or of a plurality of structures projecting at spaced intervals from one another. The recess also may be in the form of a continuous channel or, where the projecting member consists of a plurality of spaced projecting structures, the recess may consist of a plurality of recessed portions spaced from one another at intervals corresponding to the intervals between the projecting structures, with each recessed portion being sized and shaped for receiving a corresponding projecting structure in the closed position of the window.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENTS

The present invention is described in the following in connection with window assemblies of the type commonly used in residential buildings. Such assemblies generally include either one sash or a pair of sashes which are slidable vertically from a closed position to an open position to create an opening between the interior and exterior of the building. It will be appreciated, however, that the present invention is not limited to such window assemblies, but may also be used in connection with windows having horizontally slidable components, skylights which may be slidably opened, sliding doors and the like.

Figure 1:
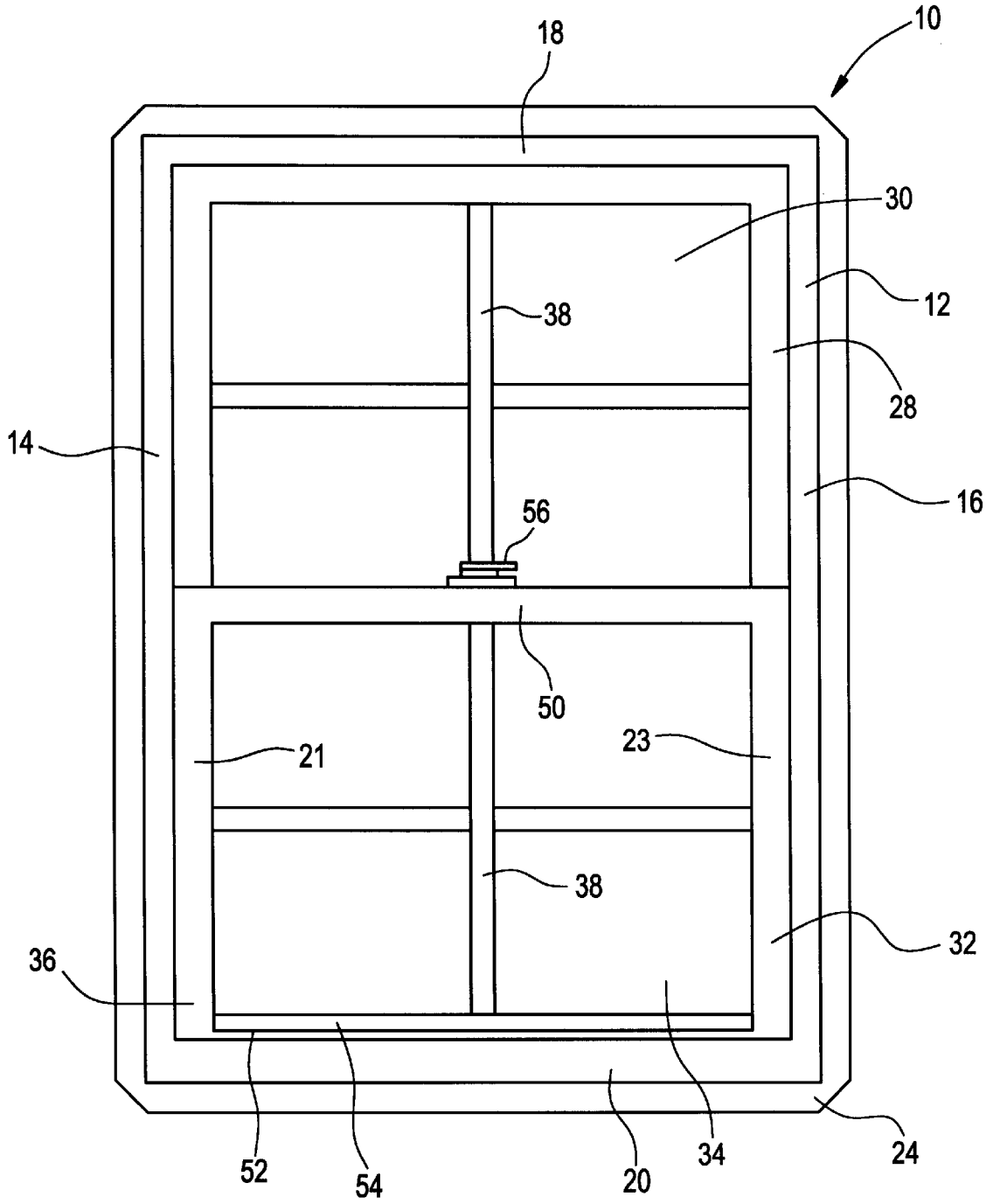
FIG. 1 is a front elevational view of a window assembly in accordance with the present invention.

A window assembly 10 in accordance with the present invention is shown in FIG. 1. The various components of window assembly 10 (other than the transparent window panels and hardware) may be made from wood, aluminum, polymers, polymer-clad wood, or other materials having structural strength and resistance to environmental exposure. In a preferred arrangement, the components of window assembly 10 may be formed from extruded polyvinyl chloride.

Referring to FIG. 1, window assembly 10 includes a frame 12 having a pair of side or jamb members 14 and 16 connected at one end to a head member 18 and at an opposite end to a sill member 20. Frame 12 is subdivided horizontally by a meeting rail 22 (FIG. 2) fixedly connected between jamb members 14 and 16. A flange 24 may project outwardly along the perimeter of frame 12 for securing the window assembly to a building or other structure.

Mounted within frame 12 are two glass units, a fixed upper unit 28 and a lower unit or sash 32 which is slidable within channels (not shown) in jamb members 14 and 16 of frame 12 (upper and lower being relative to the positions shown in FIG. 1). Upper unit 28 includes a panel of glazing 30 held in place between jamb members 14 and 16, head member 18 and meeting rail 22. Sash 32 includes a panel of glazing 34 held within a sash frame 36 defined by spaced side rails or stiles 21 and 23, a top rail 50 and a bottom rail 52. Glazings 30 and 34 may consist of any transparent or translucent panel, typically formed from glass or plaster, which allows light to pass therethrough. Glazings 30 and 34 may be formed from a single panel or from two or more panels assembled to form an insulating space therebetween.

Glazing 34 is mounted within sash 32 so as to be movably carried by sash frame 36 between open and closed positions of window assembly 10. In that regard, bottom rail 52 may include a lip 54 projecting toward the interior of the building to serve as an operating handle for raising and lowering sash 32. A pivotable latch 56 on top rail 50 may cooperate with a mating element 58 on meeting rail 22 to lock sash 32 in the closed position, as is well known in the art. A flexible strip 40 may be provided along the bottom edge of bottom rail 52 to produce a seal to prevent air and water from infiltrating between the bottom rail and sill member 20 of frame 12 in the closed position of sash 32.

Optionally, upper unit 28 and sash 32 each may include an artificial muntin 38 to create in the glazing the appearance of individual glass panes. Where the glazing consists of a single glass panel, muntins 38 would ordinarily be assembled on the outdoor side thereof. Where the glazing consists of a pair of glass panels separated by an insulating space, muntins 38 may be assembled in the space between the panels.

The general arrangement of a fixed upper unit 28 and a movable sash 32 is referred to in the window art as a single hung window. A double hung window includes movable upper and lower sashes. The window assembly 10 of the present invention may also be double hung, a single hung arrangement being shown for exemplary purposes only and not by way of limitation.

Sash 32 may be mounted to frame 12 so as to be pivotable about an axis extending parallel to top rail 50 and bottom rail 52 in order to make the normally exterior side of the sash accessible for cleaning and maintenance from the interior side of the window. In accordance with such feature, which is generally known in the art, each stile of sash 32 near the bottom end thereof may include a sash guide/pivot pin apparatus (not shown) that cooperates with a sash balance assembly (not shown) slidably assembled in jamb members 14 and 16. Similarly, each stile of sash 32 near the top end thereof may include a retractable sash guide and tilt release structure (not shown) which engages within the channels in jamb members 14 and 16. Retraction of the sash guide and tilt release structures towards the center of top rail 50 releases them from the frame channels, allowing the top of sash 32 to pivot inwardly (the outward-to-inward direction being right to left in FIG. 2) about the sash guide/pivot pin apparatus at the bottom of the sash. In a double-hung window arrangement, both sashes may be pivotable for convenient cleaning and maintenance. This feature is well known in the art and may be incorporated along with the storm-resistant features of the present invention.

Figure 2:
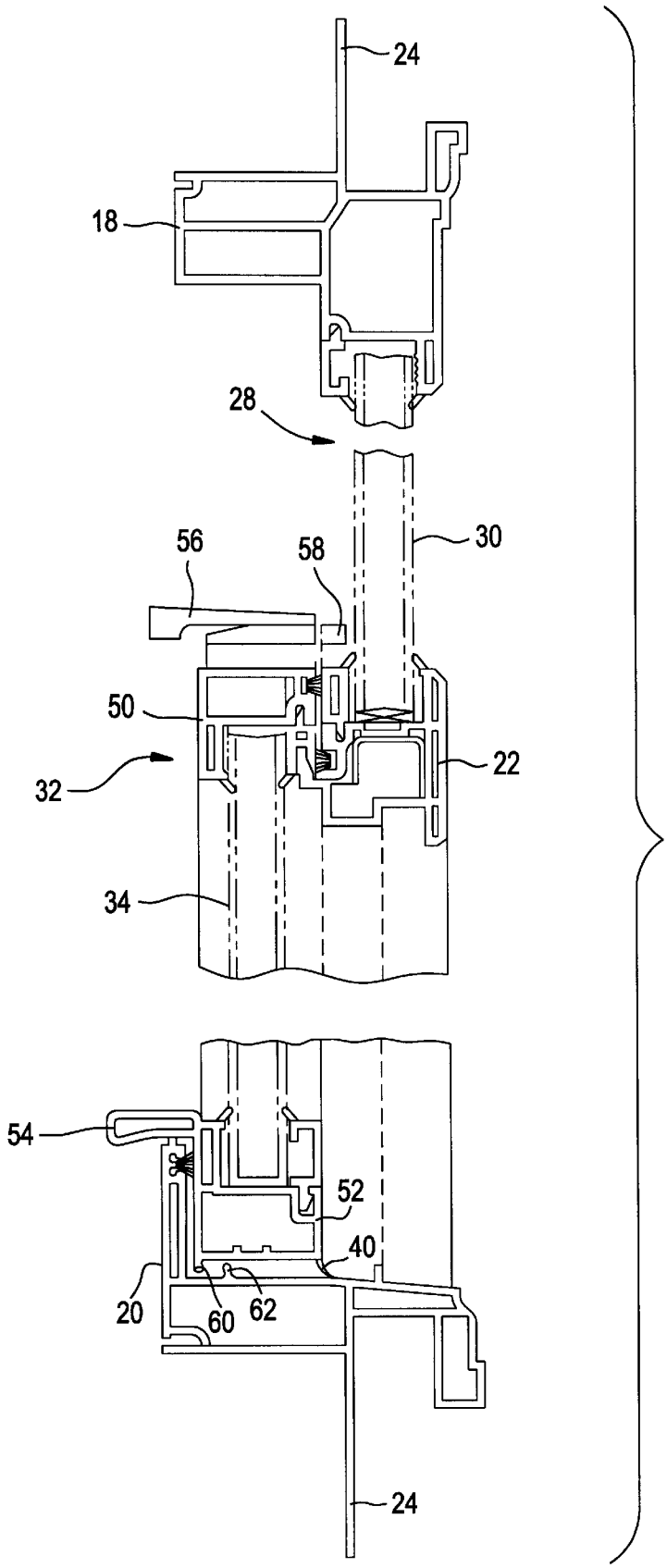
FIG. 2 is a schematic side cross-sectional view of the window assembly of FIG. 1 in the closed position.

FIG. 2 is a side cross-sectional view through window assembly 10 and shows that movable sash 32 moves in a vertical plane spaced inwardly relative to a plane extending through fixed upper unit 28.

The blowout prevention feature of the present invention may be found in the provision of a rib 60 projecting downwardly along the length of bottom rail 52 of sash 32. With window assembly 10 in the closed position, rib 60 cooperates with a rib 62 projecting upwardly along the length of sill member 20 to prevent the blowout of sash 32. Thus, as shown in FIG. 2, in the closed position of sash 32, rib 60 lies adjacent the side of rib 62 facing the interior of the building. Therefore, upon the exertion of a force tending to pull sash 32 outwardly, rib 60 will contact rib 62, preventing the bottom of sash 32 from moving transversely to its sliding plane in a direction away from the interior of the building. It will be appreciated, of course, that meeting rail 22, being fixedly secured to frame 12, will prevent top rail 50 of sash 32 from moving outwardly in the same transverse direction.

Ribs 60 and 62 need not extend continuously along the entire lengths of bottom rail 52 and sill member 20, respectively, in order to accomplish their blowout prevention function. Thus, rib 60 may be continuous and rib 62 may be in the form of a plurality of rib segments or other structures projecting upwardly at intervals along the length of sill member 20 between jamb members 14 and 16. Alternatively, rib 62 may be continuous and rib 60 may be in the form of a plurality of rib segments or other structures projecting downwardly at intervals along the length of bottom rail 52 between stiles 21 and 23. In a still further embodiment, both rib 60 and rib 62 may be in the form of a plurality of discrete rib segments or other structures which are positioned at corresponding locations along the length of bottom rail 52 and sill member 20, respectively, such that these structures may cooperate with one another to prevent sash 32 from blowing outwardly during extreme weather conditions.

Figure 3:
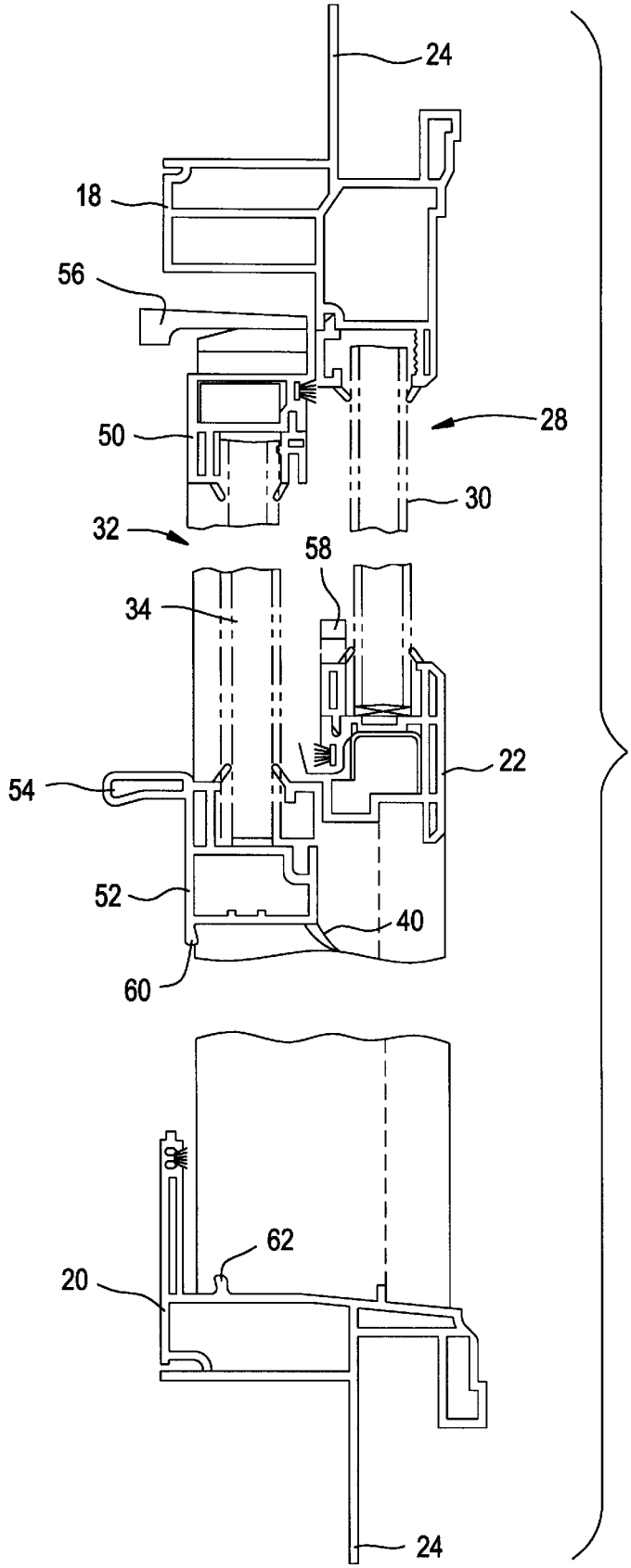
FIG. 3 is a schematic side cross-sectional view of the window assembly of FIG. 1 in the open position.

FIG. 3 is a side cross-sectional view through window assembly 10 with sash 32 in an open position. As can be seen, when sash 32 is raised vertically away from sill member 20 to an open position, rib 60 no longer lies adjacent to rib 62 and the blowout prevention feature of the present invention is inoperative. Accordingly, sash 32 must be in the closed position shown in FIG. 2, or substantially in the closed position, in order for the blowout prevention feature of the present invention to operate.

Although the blowout prevention feature of the present invention has been described above in connection with a single-hung window having a fixed upper glass unit and a movable lower sash, it will be appreciated that the invention can readily be incorporated in single-hung windows having a fixed lower glass unit and a movable upper sash. In such embodiments, the top rail of the movable sash would have a continuous rib or a plurality of rib segments or other structures projecting upwardly therefrom, and head member 18 of frame 12 would have a continuous rib or a plurality of rib segments or other structures projecting downwardly at intervals along the length thereof so as to lie outwardly adjacent the rib projecting from the top rail of the movable sash. In the closed position of the movable sash, the arrangement of these ribs adjacent to one another would prevent the movable sash from blowing outwardly as a result of extreme weather conditions. Of course, in double-hung windows having movable upper and lower sashes, the blowout prevention features of the present invention may be incorporated in both the lower movable sash and the upper movable sash.

Figure 4:
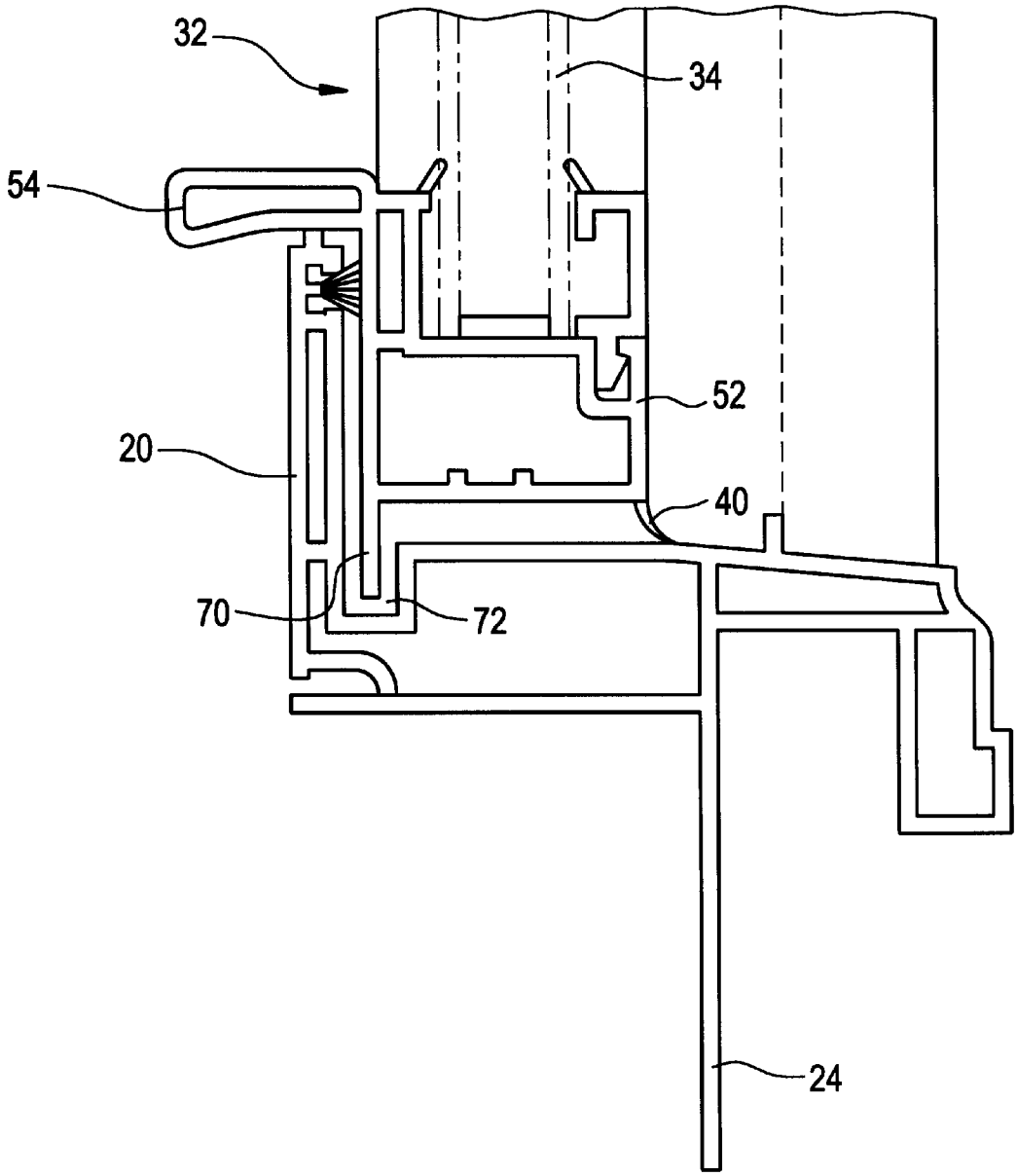
FIG. 4 is a schematic partial side cross-sectional view of an alternate embodiment of a window assembly in accordance with the present invention in the closed position.

FIG. 4 illustrates an alternate embodiment of the blowout prevention feature in accordance with the present invention. In this embodiment, rather than having an upwardly projecting rib 62, sill member 20 includes a channel 72 formed along its length. Channel 72 is sized to receive a rib 70 projecting downwardly along the length of bottom rail 52. Rib 70 is similar to rib 60 described above, but projects a greater distance from the bottom of bottom rail 52 so as to lie within channel 72 when sash 32 is in the closed position. As with the embodiment of FIG. 3, channel 72 may extend continuously along the length of sill member 20 and rib 70 may extend continuously along the length of bottom rail 52. Alternatively, channel 72 may extend continuously along the length of sill member 20 and rib 70 may be in the form of a plurality of rib segments or other structures projecting downwardly at intervals along the length of bottom rail 52 between stiles 21 and 23. In yet another arrangement, rib 70 may be in the form of a plurality of rib segments or other structures projecting downwardly at intervals along the length of bottom rail 52, and channel 72 may be in the form of a plurality of channel segments or recesses formed at corresponding intervals along the length of sill member 20. The plurality of downwardly projecting structures 70 would engage within the corresponding channel segments or recesses 72 when sash 32 is in the closed position, thereby preventing the sash from blowing outwardly in extreme weather conditions. In still further embodiments, the positions of rib or rib segments 70 and channel or channel segments 72 may be reversed, with the rib or rib segments 70 extending along the length of sill member 20 and the channel or channel segments 72 extending along the bottom of bottom rail 52. It will be appreciated, of course, that the foregoing embodiments incorporating a continuous channel or a plurality of channel segments 72 may be used in other window assemblies, including window assemblies having a movable upper sash and double-hung window assemblies having movable upper and lower sashes.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A window assembly, comprising a window frame including a pair of frame side portions connected to a pair of frame end portions;

at least one sash having a sash frame including a pair of end rails and a pair of side rails interconnecting said end rails, said at least one sash being movable in a plane within said window frame between a closed position in which one of said end rails is adjacent one of said frame end portions, and an open position in which said one of said end rails is spaced from said one of said frame end portions;

a first member projecting from said one of said frame end portions toward said one of said end rails, said first member having an inner surface facing in a first direction transverse to said plane;

a second member projecting from said one of said end rails toward said one of said frame end portions, said second member having an outer surface facing in a second direction opposite said first direction;

said first and second members being positioned adjacent one another in said closed position of said at least one sash with said inner surface of said first member confronting said outer surface of said second member so as to prevent movement of said at least one sash in said second direction.

2. The window assembly as claimed in claim 1, wherein said first member comprises a rib projecting from said one of said frame end portions.

3. The window assembly as claimed in claim 2, wherein said rib projects from said one of said frame end portions continuously from one of said frame side portions to the other one of said frame side portions.

4. The window assembly as claimed in claim 3, wherein said second member comprises a plurality of structures projecting at spaced intervals from said one of said end rails.

5. The window assembly as claimed in claim 3, wherein said second member comprises a rib projecting from said one of said end rails continuously from one of said side rails to the other one of said side rails.

6. The window assembly as claimed in claim 1, wherein said first member comprises a plurality of structures projecting at spaced intervals from said one of said frame end portions.

7. The window assembly as claimed in claim 1, wherein said second member comprises a rib projecting from said one of said end rails.

8. The window assembly as claimed in claim 7, wherein said rib projects from said one of said end rails continuously from one of said side rails to the other one of said side rails.

9. The window assembly as claimed in claim 8, wherein said first member comprises a plurality of structures projecting at spaced intervals from said one of said frame end portions.

10. The window assembly as claimed in claim 1, wherein said second member comprises a plurality of structures projecting at first spaced intervals from said one of said end rails.

11. The window assembly as claimed in claim 10, wherein said first member comprises a plurality of structures projecting at second spaced intervals from said one of said frame end portions, said second spaced intervals corresponding to said first spaced intervals.

12. A window assembly, comprising a window frame including a pair of frame side portions connected to a pair of frame end portions;

at least one sash having a sash frame including a pair of end rails and a pair of side rails interconnecting said end rails, said at least one sash being movable in a plane within said window frame between a closed position in which one of said end rails is adjacent one of said frame end portions, and an open position in which said one of said end rails is spaced from said one of said frame end portions;

a projecting member projecting from said one of said frame end portions toward said one of said end rails; and a recess formed in said one of said end rails and being sized and shaped for receiving said projecting member in said closed position of said at least one sash.

13. The window assembly as claimed in claim 12, wherein said projecting member comprises a rib projecting from said one of said frame end portions.

14. The window assembly as claimed in claim 13, wherein said rib projects from said one of said frame end portions continuously from one of said frame side portions to the other one of said frame side portions.

15. The window assembly as claimed in claim 14, wherein said recess comprises a channel extending continuously in said one of said end rails from one of said side rails to the other one of said side rails.

16. The window assembly as claimed in claim 12, wherein said projecting member comprises a plurality of structures projecting at spaced intervals from said one of said frame end portions.

17. The window assembly as claimed in claim 16, wherein said recess comprises a channel extending continuously in said one of said end rails from one of said side rails to the other one of side rails.

18. The window assembly as claimed in claim 12, wherein said projecting member comprises a plurality of structures projecting at first spaced intervals from said one of said frame end portions, and said recess comprises a plurality of recessed portions formed at second spaced intervals in said one of said end rails, said second spaced intervals corresponding to said first spaced intervals, each one of said plurality of recessed portions being sized and shaped for receiving a corresponding one of said plurality of projecting structures in said closed position of said at least one sash.

19. A window assembly, comprising a window frame including a pair of frame side portions connected to a pair of frame end portions;

at least one sash having a sash frame including a pair of end rails and a pair of side rails interconnecting said end rails, said at least one sash being movable in a plane within said window frame between a closed position in which one of said end rails is adjacent one of said frame end portions, and an open position in which said one of said end rails is spaced from said one of said frame end portions;

a projecting member projecting from said one of said end rails toward said one of said frame end portions; and a recess formed in said one of said frame end portions and being sized and shaped for receiving said projecting member in said closed position of said at least one sash.

20. The window assembly as claimed in claim 19, wherein said projecting member comprises a rib projecting from said one of said end rails.

21. The window assembly as claimed in claim 20, wherein said rib projects from said one of said end rails continuously from one of said side rails to the other one of said side rails.

22. The window assembly as claimed in claim 21, wherein said recess comprises a channel extending continuously in said one of said frame end portions from one of said frame side portions to the other one of said frame side portions.

23. The window assembly as claimed in claim 19, wherein said projecting member comprises a plurality of structures projecting at spaced intervals from said one of said end rails.

24. The window assembly as claimed in claim 23, wherein said recess comprises a channel extending continuously in said one of said frame end portions from one of said frame side portions to the other one of said frame side portions.

25. The window assembly as claimed in claim 19, wherein said projecting member comprises a plurality of structures projecting at first spaced intervals from said one of said end rails, and said recess comprises a plurality of recessed portions formed at second spaced intervals in said one of said frame end portions, said second spaced intervals corresponding to said first spaced intervals, each one of said plurality of recessed portions being sized and shaped for receiving a corresponding one of said plurality of projecting structures in said closed position of said at least one sash.

* * * * *

UNITED STATES PATENT AND TRADEMARK OFFICE

CERTIFICATE OF CORRECTION

PATENT NO. : 6,243,999 B1
DATED : June 12, 2001
INVENTOR(S) : Silverman

It is certified that error appears in the above-identified patent and that said Letters Patent is hereby corrected as shown below:

Column 1,
Line 12, "weather tight" should read -- weather-tight --.

Column 7,
Line 25, after "other one of" insert -- said --.

Signed and Sealed this

Fifteenth Day of January, 2002

*Attest:*

*Attesting Officer*

JAMES E. ROGAN
*Director of the United States Patent and Trademark Office*

US006243999C1

(12) EX PARTE REEXAMINATION CERTIFICATE (5936th)

United States Patent
Silverman

(10) Number: US 6,243,999 C1
(45) Certificate Issued: Oct. 9, 2007

(54) BLOW-OUT PREVENTION MECHANISM FOR WINDOWS

(75) Inventor: Arthur Silverman, Warren, NJ (US)

(73) Assignee: Silver Line Building Products Corporation, North Brunswick, NJ (US)

Reexamination Request:
No. 90/007,853, Dec. 14, 2005
No. 90/008,176, Sep. 12, 2006

Reexamination Certificate for:
Patent No.: 6,243,999
Issued: Jun. 12, 2001
Appl. No.: 09/304,976
Filed: May 4, 1999

Certificate of Correction issued Jan. 15, 2002.

(51) Int. Cl.
*E06B 3/32* (2006.01)

(52) U.S. Cl. ..... 52/204.51; 52/204.62; 52/204.7; 52/207; 52/213; 52/656.5; 52/775; 52/656.7; 52/656.6; 49/449; 49/501

(58) Field of Classification Search ..... 49/181, 49/446, 456, 459, 455, 449
See application file for complete search history.

(56) References Cited

U.S. PATENT DOCUMENTS

| | | | |
|---|---|---|---|
| 2,570,523 | A | 10/1951 | Clerk |
| 3,105,576 | A | 10/1963 | Jones et al. |
| 3,600,854 | A | 8/1971 | Dallaire et al. |
| 4,949,506 | A | 8/1990 | Durham, Jr. |
| 5,560,154 | A | 10/1996 | Matarazzo |

*Primary Examiner*—Matthew C. Graham

(57) ABSTRACT

A storm-resistant window includes a mechanism for preventing the blowout of a movable sash when wind pressure pulls the sash outwardly. In a single hung window having a slidable lower sash, the mechanism consists of a first rib projecting downwardly from the bottom rail of the lower sash and a second rib projecting upwardly from the top of the sill member of the window frame. In a closed position of the window, the first rib lies inwardly adjacent the second rib such that, if wind pressure pulls the movable sash outwardly, the first rib will contact the second rib, preventing the bottom rail of the movable sash from moving outwardly. In an alternate embodiment, one of the ribs may be replaced with a channel, so that the remaining rib is received in the channel in the closed position of the window.

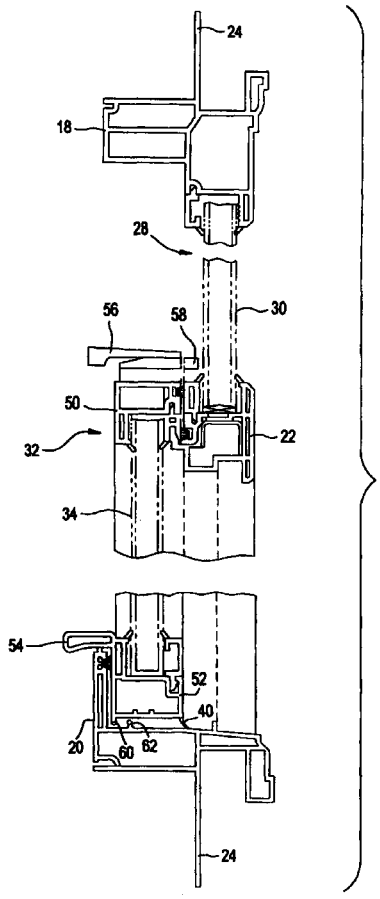

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 5, 7, 12, 13, 19 and 20 are determined to be patentable as amended.

Claims 3, 4, 6, 8–11, 14–18 and 21–25, dependent on an amended claim, are determined to be patentable.

New claim 26 is added and determined to be patentable.

1. A window assembly, comprising a window frame including a pair of frame side portions connected to a pair of frame end portions;

at least one sash having a sash frame including a pair of end rails and a pair of side rails interconnecting said end rails, said at least one sash being movable in a plane within said window frame between a closed position in which one of said end rails is adjacent one of said frame end portions, and an open position in which said one of said end rails is spaced from said one of said frame end portions;

a first member projecting from said one of said frame end portions toward said one of said end rails, said first member having an inner surface facing in a first direction transverse to said plane*, said first member not being in contact with any other element of said at least one sash in said closed position of said at least one sash*;

a second member projecting from said one of said end rails toward said one of said frame end portions, said second member having an outer surface facing in a second direction opposite said first direction*, said second member not being in contact with any other element of said window frame in said closed position of said at least one sash*;

said first and second member being positioned adjacent *and spaced apart from* one another in said closed position of said at least one sash with said inner surface of said first member confronting *and being spaced apart from* said outer surface of said second member so as to prevent movement of said at least one sash in said second direction*, in that, upon the exertion of a force tending to pull said at least one sash in said second direction, said first and second members contact each other*.

2. The window assembly as claimed in claim 1, wherein said first member comprises a *solid* rib projecting from said one of said frame end portions.

5. The window assembly as claimed in claim 3, wherein said second member comprises a *solid* rib projecting from said one of said end rails continuously from one of said side rails to the other one of said side rails.

7. The window assembly as claimed in claim 1, wherein said second member comprises a *solid* rib projecting from said one of said end rails.

12. A window assembly, comprising a window frame including a pair of frame side portions connected to a pair of frame end portions;

at least one sash having a sash frame including a pair of end rails and a pair of side rails interconnecting said end rails, said at least one sash being movable in a plane within said window frame between a closed position in which one of said end rails is adjacent one of said frame end portions, and an open position in which said one of said end rails is spaced from said one of said frame end portions;

a projecting member projecting from said one of said frame end portions toward said one of said end rails*, said projecting member not being in contact with any other elements of said at least one sash in said closed position of said at least one sash*; and a recess formed in said one of said end rails and being sized and shaped for receiving *but not touching* said projecting member in said closed position of said at least one sash *so as to prevent movement of at least a portion of said at least one sash, in that, upon the exertion of a force tending to pull said at least one sash away from said window frame, said projecting member and said recess contact each other*.

13. The window assembly as claimed in claim 12, wherein said projecting member comprises a *solid* rib projecting from said one of said frame end portions.

19. A window assembly, comprising a window frame including a pair of frame side portions connected to a pair of frame end portions;

at least one sash having a sash frame including a pair of end rails and a pair of side rails interconnecting said end rails, said at least one sash being movable in a plane within said window frame between a closed position in which one of said end rails is adjacent one of said frame end portions, and an open position in which said one of said rails is spaced from said one of said frame end portions;

a projecting member projecting from said one of said end rails toward said one of said frame end portions; *said projecting member not being in contact with any other element of said window frame in a closed position of said at least one sash* and a recess formed in said one of said frame end portions and being sized and shaped for receiving *but not touching* said projecting member in said closed position of said at least one sash *so as to prevent movement of at least a portion of said at least one sash, in that, upon the exertion of a force tending to pull said at least one sash away from said window frame, said projecting member and said recess contact each other*.

20. The window assembly as claimed in claim 19, wherein said projecting member comprises *a solid* rib projecting from said one of said end rails.

*26. A window assembly, comprising*

*a window frame including a pair of frame side portions connected to a pair of frame end portions;*

*at least one sash having a sash frame including a pair of end rails and a pair of side rails interconnecting said end rails, said at least one sash being movable in a plane within said window frame between a closed position in which one of said end rails is adjacent one of said frame end portions, and an open position in which said one of said end rails is spaced from said one of said frame end portions;*

*a first member projecting from said one of said frame end portions toward said one of said end rails, said first member having an inner surface facing in a first direction transverse to said plane, wherein said first member comprises a solid rib projecting from said one of said frame end portions continuously from one of said frame side portions to the other one of said frame side portions, said first member not being in contact with any other element of said at least one sash in a closed position if said at least one sash;*

*a second member projecting from said one of said end rails toward said one of said frame end portions, said second member having an outer surface facing in a second direction opposite said first direction, wherein said second member comprises a solid rib projecting from said one of said end rails continuously from one said side rails to the other one of said side rails, said rib not being in contact with any other element of said window frame in said closed position of said at least one sash;*

*said first and second members being positioned adjacent one another in said closed position of said at least one sash with said inner surface of said first member confronting said outer surface of said second member so as to prevent movement of said at least one sash in said second direction, in that, upon the exertion of a force tending to pull said at least one sash in said second direction, said first and second members contact each other.*

* * * * *